US006354059B1

(12) United States Patent
Yoshie et al.

(10) Patent No.: US 6,354,059 B1
(45) **Date of Patent: *Mar. 12, 2002**

(54) SHEET FINISHER AND IMAGE FORMING APPARATUS THEREWITH

(75) Inventors: Kohji Yoshie; Hiroyuki Wakabayashi; Masato Hattori; Teruhiko Toyoizumi; Masaru Ohtsuka; Tetsuhiro Kodera, all of Hachioji; Makoto Tamura, Urawa, all of (JP)

(73) Assignee: Konica Corporation (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/383,820

(22) Filed: Aug. 27, 1999

(30) Foreign Application Priority Data

Sep. 2, 1998 (JP) ..... 10-248324

(51) Int. Cl.[7] ..... B65B 63/04

(52) U.S. Cl. ..... 53/117; 493/405; 270/37; 270/58.08

(58) Field of Search ..... 270/32, 37, 38, 270/58.07, 58.08; 493/320, 325, 405; 53/117

(56) References Cited

U.S. PATENT DOCUMENTS 4,878,656 A * 11/1989 Honjo et al.
5,257,081 A * 10/1993 Kato et al.
5,382,011 A * 1/1995 Tani
5,881,352 A * 3/1999 Kobayashi et al.
6,027,107 A * 2/2000 Natsume et al.

* cited by examiner

*Primary Examiner*—Eugene Kim
(74) *Attorney, Agent, or Firm*—Bierman, Muserlian and Lucas

(57) ABSTRACT

A sheet finisher includes: a stacking member for aligning a plurality of recording sheets each on which an image has been recorded and for stacking the plurality of recording sheets thereon; a cover sheet feeding member having a cover sheet loading section for loading a cover sheet, for feeding the cover sheet stacked on the cover sheet loading section to the stacking member; a stapling member for stapling the cover sheet and the recording sheets stacked on the stacking member; and a folding member for folding the cover sheet and the recording sheets into two. The cover sheet feeding member, the stacking member and the folding member are substantially vertically arranged in the order from an upper portion to a lower portion of the sheet finisher.

16 Claims, 9 Drawing Sheets

SHEET FINISHER AND IMAGE FORMING APPARATUS THEREWITH

BACKGROUND OF THE INVENTION

The present invention relates to a sheet finisher having functions to conduct finishing actions such as stapling and folding for a combination of recording sheets ejected out of an image forming apparatus such as an electrophotographic copying machine, a printer and a facsimile machine and a cover sheet (a cover).

As an apparatus to collate a plurality of recording sheets each having thereon a recorded image ejected out of an image forming apparatus and to staple them with a stapler for each number of copies, a sheet finisher called a finisher is used.

The finisher is connected to an image forming apparatus main body such as a copying machine or a printer in terms of functions, and is driven to operate, interlocking with a sequence of operations of copying or printing process.

Therefore, the image forming apparatus capable of conducting image forming process at high speed requires a finisher capable of conducting high speed processing which can fulfill its functions, conforming to the processing speed of the image forming apparatus.

Finishers like that explained above are already disclosed in Japanese TOKKAISHO Nos. 60-142359, 60-158463, 62-239169, 62-288002, 63-267667, Japanese TOKKAIHEI Nos. 2-276691, 8-319054, and Japanese TOKKOHEI No. 5-41991.

A bookbinding apparatus disclosed in Japanese TOKKAISHO No. 60-183459 is one wherein a cover supplying device is provided, and bookbinding finishing work such as punching or stapling is carried out after copy sheets and a cover are superposed.

Disclosed in Japanese TOKKAIHEI Nos. 6-72064, 7-187479 and 8-192951 represents a sheet finisher having a function of midway stapling.

A sheet finisher disclosed in Japanese TOKKAIHEI No. 10-148983 is one having a sheet folding means which folds a sheet in two.

(1) A conventional sheet finisher having a sheet folding means has a problem that it requires a large floor space because a sheet conveyance path is arranged to be horizontal in the sheet finisher.

(2) In the sheet finisher, plural sets of paired rollers each set being composed of a driving roller and a driven roller need to be arranged for plural sheet conveyance paths, which results in a problem of complicated driving systems in the sheet finisher.

(3) The structure of plural sheet conveyance paths in the sheet finisher is simplified to improve sheet conveying capability.

In a sheet finisher wherein plural recording sheets and a cover are superposed and are conveyed to a sheet finishing section, the control of automatic mode for superposing a cover sheet on recording sheets ejected out of an image forming apparatus and for finishing and the control of manual mode in which recording sheets representing the contents and a cover sheet representing a cover are superposed in advance, and then finishing is carried out are provided selectively, so that the sheet finisher itself may fulfill the function as a sheet folding machine.

SUMMARY OF THE INVENTION

An object of the present invention is to solve the aforesaid problems of the conventional sheet finisher and to provide a compact and inexpensive sheet finisher which can be operated easily.

The object stated above can be attained by either one of the following structures.

Structure 1

A sheet finisher having therein a conveyance means which successively receives and conveys recording sheets each having thereon a formed image conveyed out of an image forming apparatus, a stacking means which positions recording sheets received and stacks them, a cover sheet feeding means which feeds out a cover sheet stacked on a cover sheet loading section with a feed-out means and places it on the stacking means mentioned above, a stapling means which staples the recording sheets and the cover sheet both stacked on the stacking means, and a folding means which folds the recording sheets and the cover sheet wherein the cover sheet is placed, with its first surface facing upward, on the cover sheet loading section, then the cover sheet is conveyed by the cover sheet feed-out means to be sent to the stacking means where the recording sheets conveyed by the conveyance means and the cover sheet are stacked and positioned to be subjected to midway stapling by the stapling means, and the cover sheet and the recording sheets thus subjected to midway stapling are conveyed again to be folded in two, and are ejected onto a sheet delivery tray.

Structure 2

A sheet finisher having therein a conveyance means which successively receives and conveys recording sheets each having thereon a formed image conveyed out of an image forming apparatus, a stacking means which positions recording sheets received and stacks them, a cover sheet feeding means which feeds out a cover sheet stacked on a cover sheet loading section with a feed-out means and places it on the stacking means mentioned above, a stapling means which staples the recording sheets and the cover sheet both stacked on the stacking means, and a folding means which folds the recording sheets and the cover sheet wherein the cover sheet loading section arranged on the uppermost step in the main body of the sheet finisher, the stacking means and the stapling means both arranged under the cover sheet loading section, and the folding means arranged under the stacking means and the stapling means are arranged lengthwise in the vertical direction.

Structure 3

A sheet finisher having therein a conveyance means which successively receives and conveys recording sheets each having thereon a formed image conveyed out of an image forming apparatus, a stacking means which positions recording sheets received and stacks them, a cover sheet feeding means which feeds out a cover sheet stacked on a cover sheet loading section with a feed-out means and places it on the stacking means mentioned above, a stapling means which staples the recording sheets and the cover sheet both stacked on the stacking means, and a folding means which folds the recording sheets and the cover sheet wherein a fixed sheet delivery tray which receives recording sheets conveyed out of the image forming apparatus and stacks them for housing without finishing them is arranged above the cover sheet loading section, a second conveyance path through which the cover sheet fed out of the cover sheet feed-out means is conveyed to the stacking means is arranged to adjoin the first conveyance path through which the recording sheets are conveyed to the fixed sheet delivery tray, and the recording sheets in the first conveyance path and the cover sheet in the second conveyance path are conveyed in the opposite direction each other by a common driving roller.

Structure 4

A sheet finisher having therein a conveyance means which successively receives and conveys recording sheets each having thereon a formed image conveyed out of an image forming apparatus, a stacking means which positions recording sheets received and stacks them, a cover sheet feeding means which feeds a cover sheet stacked on a cover sheet loading section to place it on the stacking means, a stapling means which staples the recording sheets and the cover sheet both stacked on the stacking means, and a folding means which folds the recording sheets and the cover sheet wherein the conveyance path for the cover sheet fed out of the cover sheet loading section is arranged so that it joins at the point which is upstream side of the division point between a path which receives recording sheets conveyed out of the image forming apparatus and conveys them to the stacking means and a conveyance path for ejecting without finishing.

Structure 5

An image forming apparatus equipped with a sheet finisher having therein a conveyance means which successively receives and conveys recording sheets each having thereon a formed image conveyed out of an image forming apparatus, a stacking means which positions recording sheets received and stacks them, a cover sheet feeding means which feeds a cover sheet stacked on a cover sheet loading section to place it on the stacking means, a stapling means which staples the recording sheets and the cover sheet both stacked on the stacking means, and a folding means which folds the recording sheets and the cover sheet wherein there are provided an automatic mode in which the cover sheet fed from the cover sheet loading section is conveyed to be placed on the stacking means, then the recording sheets each having thereon a formed image conveyed out of the image forming apparatus are received successively to be conveyed onto the stacking means by the conveyance means, and after the cover sheet and the recording sheets are superposed on the stacking means, they are finished by the stapling means and/or the folding means so that booklets are made continuously, and a manual mode in which a cover sheet and recording sheets both equivalent to one booklet are stacked on the cover sheet loading section, and the cover sheet and recording sheets are fed out by the cover sheet feed-out means to be stacked on the stacking means and to be finished by the stapling means and/or the folding means so that a booklet is made, and the automatic mode to make booklets is controlled by the operation section on the part of the image forming apparatus, while the manual mode to make a booklet is controlled by the operation section on the part of the sheet finisher.

Figure 8:
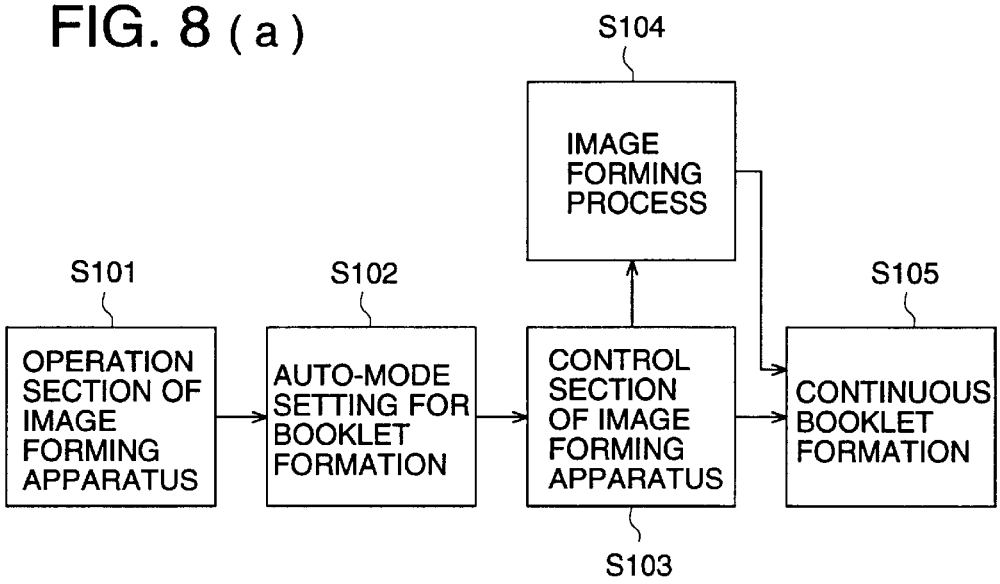
Figure 8:
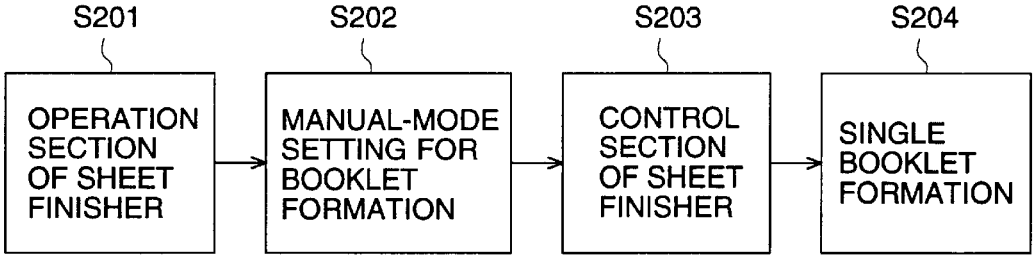

Each of FIGS. 8(*a*) and 8(*b*) is a block diagram showing the control of the sheet finisher of the invention.

Figure 9:
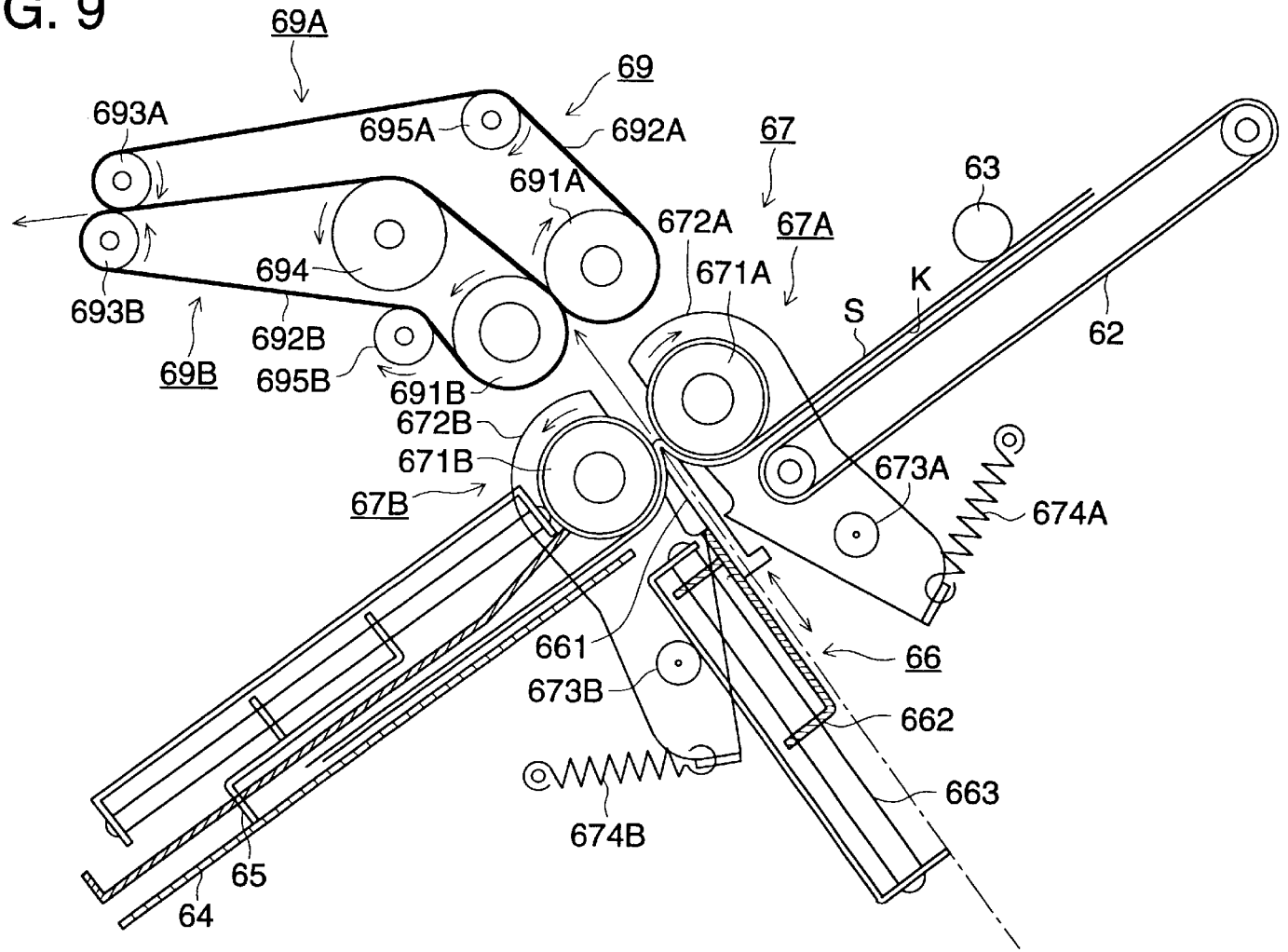

FIG. 9 is a sectional view showing another embodiment of the sheet finisher of the invention.

DETAILED DESCRIPTION OF THE PREFERRED EMBODIMENT

Next, an embodiment of the sheet finisher of the invention will be explained based on the drawings attached herewith.

Figure 1:
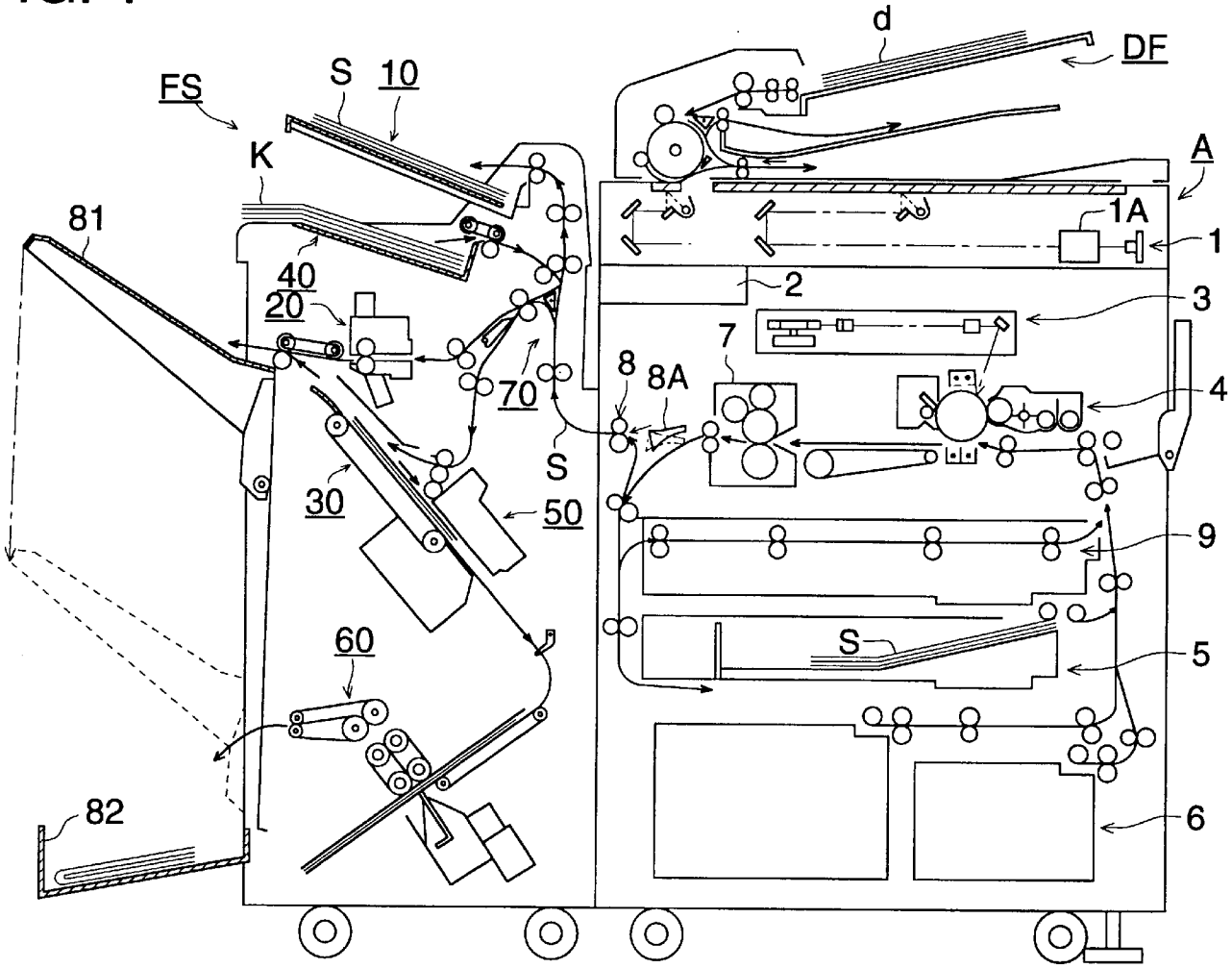
FIG. 1 is a total structure diagram of an image forming apparatus equipped with a sheet finisher and an automatic document feeder.

FIG. 1 is a total structure diagram of image forming apparatus A equipped with sheet finisher FS and automatic document feeder DF.

The illustrated image forming apparatus A is provided with image reading section 1, image processing section 2, image writing section 3, image forming section 4, cassette sheet feeding section 5, large capacity tray (LCT) 6, fixing unit 7, sheet ejection section 8, and automatic duplex unit (ADU) 9.

On the upper part of the image forming apparatus A, there is mounted automatic document feeder DF. On the part of sheet ejection section 8 on the illustrated left side of the image forming apparatus A, there is connected sheet finisher FS.

Document D placed on the document stand of the automatic document feeder DF is conveyed in the arrowed direction, and an image on one side of the document or images on both sides to the document are read by an optical system of image reading section (scanning exposure device) 1, and are read in CCD image sensor 1A.

Analog signals obtained through photoelectric conversion by CCD image sensor 1A are subjected to analog processing, A/D conversion, shading correction and image compression processing at image processing section 2, and signals are sent to image writing section 3.

In the image writing section 3, light outputted from a semiconductor laser is projected on a photoreceptor drum of image forming section 4, and a latent image is formed. In the image forming section 4, charging, exposure, developing, transfer, separation and cleaning are conducted, and an image is transferred onto recording sheet S fed out of cassette sheet feeding section 5 or large capacity tray 6. The recording sheet S carrying an image is fixed by fixing unit 7 and then is fed into sheet finisher FS from sheet ejection section 8. Or, recording sheet S whose one side has been finished in terms of image processing which has been fed into the automatic duplex unit 9 by conveyance path switching plate 8A is subjected to two-sided image processing at the image forming section 4 again, and is fed into the sheet finisher FS from the sheet ejection section 8.

On the sheet finisher FS, fixed sheet ejection tray (top tray) 10, cover sheet feeding means 40, shift processing conveyance section (large capacity sheet ejection conveyance section) 20, stacking means 30, stapling means (stapler) 50, and folding means 60 are arranged lengthwise almost in the vertical direction from the upper portion in the drawing.

On the upper portion on the right side on the illustration of the sheet finisher FS, there is arranged entrance conveyance section 70. On the left side on the illustration of the sheet finisher FS, there are arranged movable sheet ejection tray 81 receiving the sheet finished in terms of edge stapling and shift processing and fixed sheet ejection tray 82 receiving the sheet finished in terms of midway stapling and folding processing.

Figure 2:
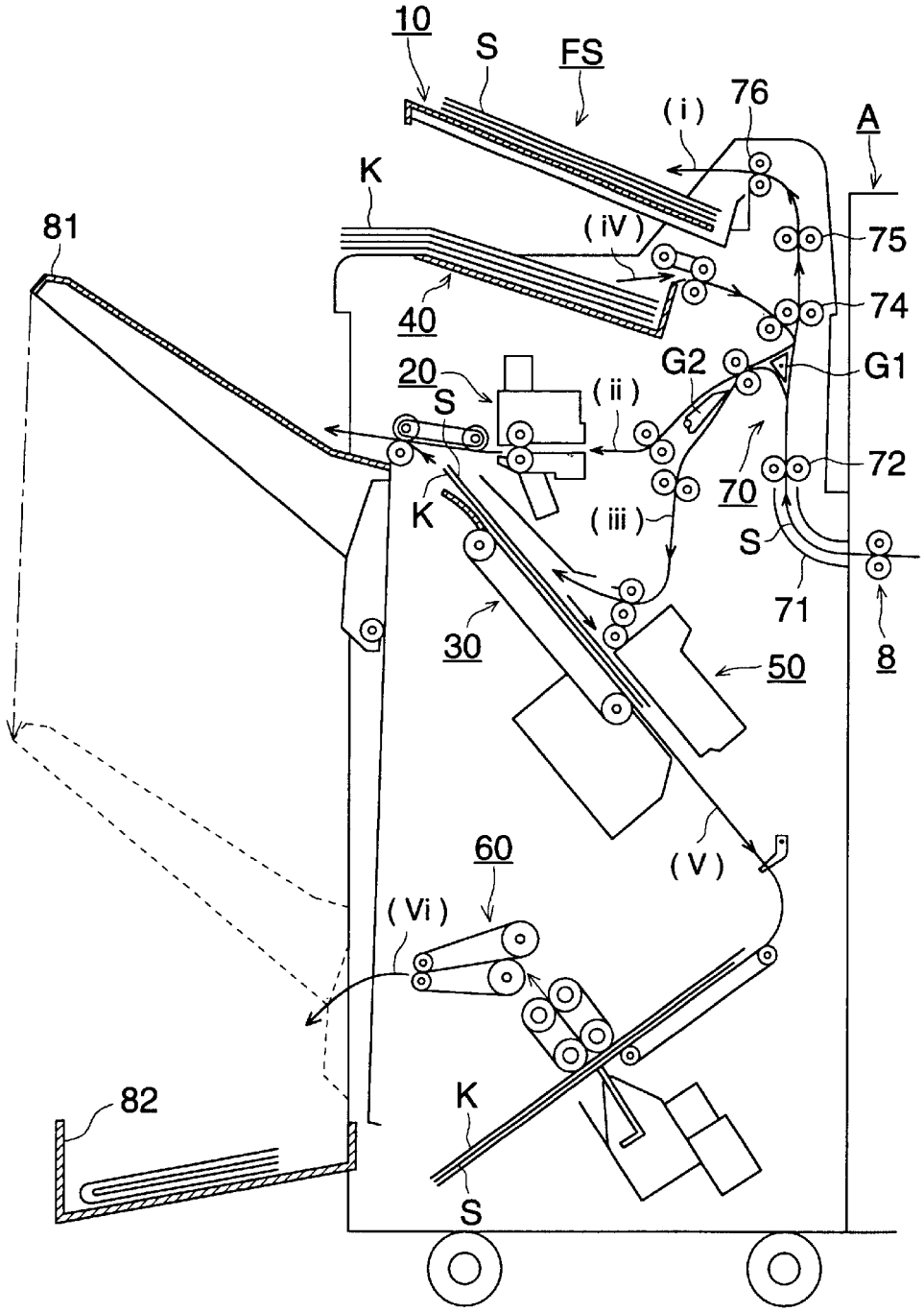
FIG. 2 is an illustration diagram showing a sheet conveyance path of the sheet finisher.
Figure 3:
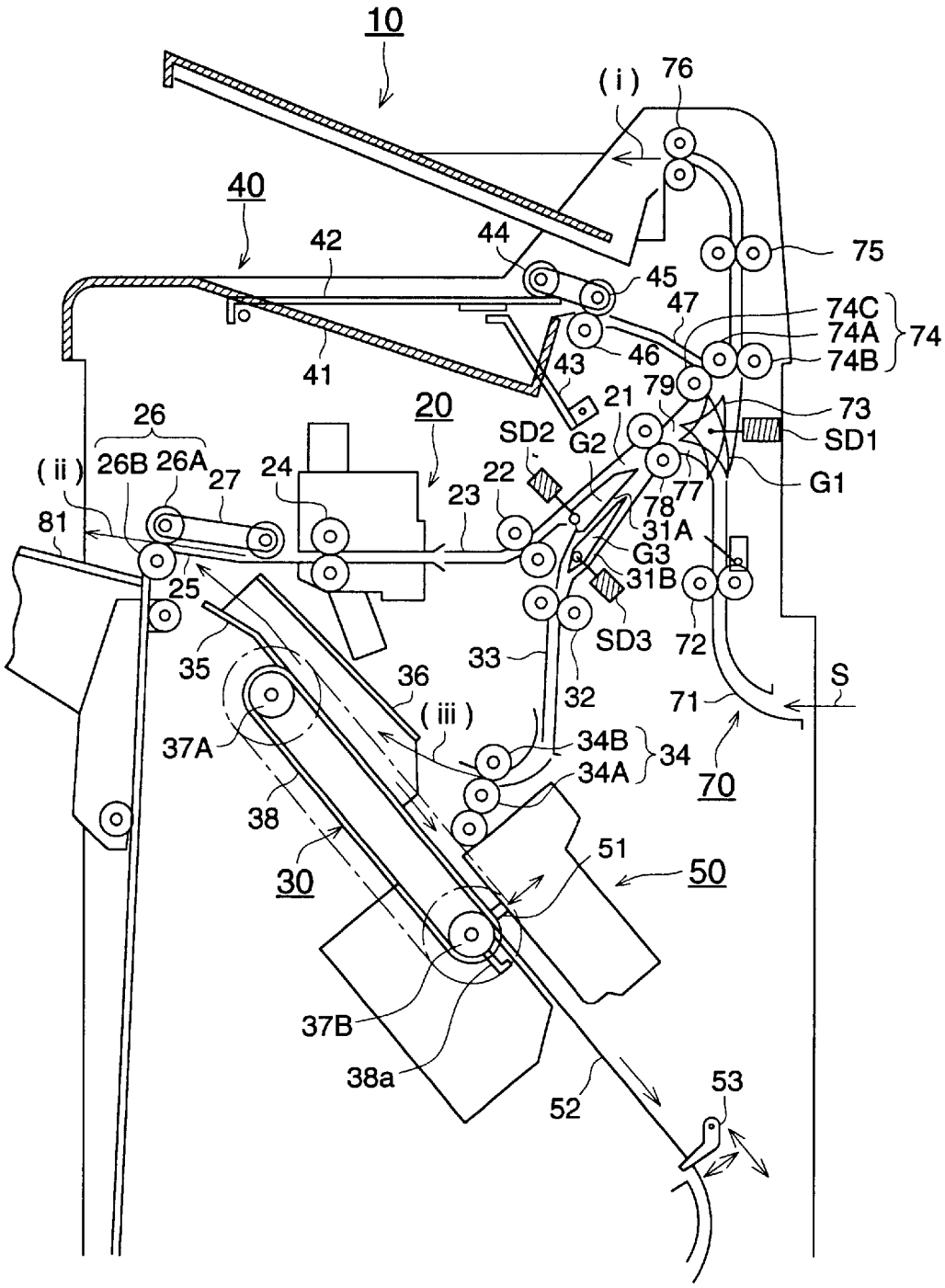
FIG. 3 is a sectional view showing the upper mechanism of the sheet finisher.

FIG. 2 is an illustration diagram showing the sheet conveyance path of sheet finisher FS, and FIG. 3 is a sectional view showing the upper mechanism of the sheet finisher FS.

The sheet finisher FS is installed by adjusting its position and height so that receiving portion 71 for recording sheet S conveyed out of image forming apparatus A may agree with sheet ejection section 8 of the image forming apparatus A.

A conveyance path for recording sheet S where entrance paired rollers 72 at the receiving portion 71 is connected to the downstream part of sheet conveyance is divided into three routes including first conveyance path (i) on the upper step, second conveyance path (ii) on the middle step and third conveyance path (iii) on the lower step, and they are arranged so that recording sheet S is directed to either one of them by selecting an angle formed by switching gates G1 and G2.

(1) First conveyance path (i) (for sheet ejection to fixed sheet ejection tray 10 on the upper part of the apparatus in non-staple mode and non-sort mode)

Recording sheet S having thereon a formed image ejected out of image forming apparatus A is guided to the receiving portion 71, then is conveyed by entrance paired rollers 72, then passes through path 73 on the right side of first switching gate G1 on the upper part, then is nipped by upper conveyance paired rollers 74 (driving roller 74A, driven roller 74B) and by conveyance paired roller 75 to be conveyed upward, and is further nipped by ejection paired rollers 76 to be ejected and stacked successively on fixed sheet ejection tray 10 located at the upper portion outside the apparatus.

In this process of sheet conveyance, switching gate GI is swiveled by solenoid SD1 through its driving to close path 77 and to open path 73, making it possible for recording sheet S to pass to fixed sheet ejection tray 10.

As a capacity, the fixed sheet ejection tray 10 can hold the maximum of about 200 recording sheets S, and it can easily be taken out of the upper portion of sheet finisher FS.

(2) Second conveyance path (ii) (for sheet ejection to movable sheet ejection tray 81 in offset mode or non-sort mode)

Under this conveyance mode, switching gate G1 closes path 73 and opens path 77 when solenoid SD1 is turned off, making it possible for recording sheet S to pass through path 77.

Recording sheet S having thereon a formed image ejected out of image forming apparatus A passes through receiving portion 71 and entrance paired rollers 72, then passes through path 77 formed to be open under switching gate G1, then is nipped by conveyance paired rollers 78, then passes through path 21 above second switching gate G2 located downward obliquely which represents second conveyance path (ii), then is nipped by conveyance paired rollers 22, then passes through path 23, then is nipped by conveyance paired rollers (paired shift rollers) 24, then passes through path 25 to be ejected by ejection paired rollers 26 (upper roller 26A, lower roller 26B) and stacked on movable sheet ejection tray 81 which is located outside the apparatus. The numeral 27 represents a swiveling means which swivels upper roller 28A so that it may be brought into pressure contact with or separated from a lower roller.

As capacity, this movable sheet ejection tray 81 can hold the maximum of about 3000 (A4, B5) recording sheets S.

(3) Third conveyance path (iii) (for sheet ejection to movable sheet ejection tray 81 in stapling mode)

Recording sheet S having thereon a formed image processed in image forming apparatus A and fed into receiving portion 71 of sheet finisher FS passes through entrance paired rollers 72 and path 77 located under the first switching gate G1 and is nipped by entrance paired rollers 78 to be conveyed to third conveyance path (iii).

In the third conveyance path (iii), when large-sized recording sheet S larger than A4 and B5 is conveyed, solenoid SD1 is driven and recording sheet S passes through path 31A under switching gate G2 and is nipped by conveyance paired rollers 32 located at downstream portion to be further conveyed. The recording sheet S is nipped by conveyance paired rollers 34 located further at downstream portion (driving roller 34A, driven roller 34B) to be fed out, then is discharged into space above intermediate stacker 35 arranged to be inclined, and comes in contact with the upper surface of the intermediate stacker 35 or the upper surface of recording sheets S stacked on the intermediate stacker 35, then slides thereon to go up, and after the trailing edge of the recording sheet S is ejected out of the conveyance paired rollers 34, the recording sheet S starts falling by its own weight, then slides down along the inclined surface of the intermediate stacker 35, and stops with its trailing edge portion hitting movable stopper member (sheet stopper surface) 51 which is in the vicinity of stapling means (stapler, stapling means) 50.

In the third conveyance path (iii), for improving copy productivity by conveying efficiently and continuously small-sized recording sheets S in A4 and B5 sizes, there are provided path 31B which is in parallel with path 31A lying under the switching gate G1 and switching gate G3.

When solenoid SD2 for switching gate G2 and solenoid SD3 for switching gate G3 are driven simultaneously, tip portions of the switching gates G2 and G3 swivel counterclockwise in the illustration to close the paths 21 and 31A and to open the path 31B. The tip portion of the second recording sheet S fed out of conveyance paired rollers 78 passes through the path 31B and stops after hitting the circumferential surface of the conveyance paired rollers 34 whose rotation is interrupted.

Next, electricity to solenoid SD2 is turned off, and the tip portion of switching gate G3 swivels clockwise to close path 31B and to open path 31A. The tip portion of the first recording sheet S fed out of conveyance paired rollers 78 passes through path 31B and stops after hitting the circumferential surface of the conveyance paired rollers 34 whose rotation is interrupted.

Taking the prescribed timing, the conveyance paired rollers 34 are driven to rotate and nip the two recording sheets S to convey them simultaneously, and discharge them on the intermediate stacker 35.

The numeral 36 represents a pair of width-adjusting members provided on both sides of the intermediate stacker 35 on a movable manner. The width-adjusting members 36 can move in the direction perpendicular to the sheet conveyance direction, and it is opened to be broader than the sheet width when recording sheet S is discharged on the intermediate stacker 35 and the sheet is received, and it conducts width-adjusting for a bundle of sheets by tapping the side in the lateral direction of the recording sheets S. When prescribed number of recording sheets S are stacked and adjusted on the intermediate stacker 35 at this stop position, the process of stapling (stapling process) is carried out by stapler 50, and a bundle of sheets is stapled.

On a part of a sheet stacking surface of the intermediate stacker 35, there is formed a cutout portion, and plural ejection belts 38 trained about driving pulley 37A and driven pulley 37B are driven to be capable of rotating. On a part of the ejection belt 38, there is solidly formed ejection claw 38*a*, and the tip portion of the ejection claw draws a locus of an elongated circle shown with a one-dot chain line in the illustration. A bundle of sheets which has been stapled is put on the ejection belt 38 with a rear end of the bundle of recording sheets S being supported by the ejection claw 38*a* of the ejection belt 38, and is pushed upward obliquely to slide on the stacking surface of the intermediate stacker 35 and to advance to the nipping position for ejection paired rollers 26. The bundle of sheets nipped by the rotating ejection paired rollers 26 is ejected and stacked on movable sheet ejection tray 81.

(4) Fourth conveyance path (iv) (cover sheet feeding mode)

Cover sheet feeding means 40 is structured with a cover sheet loading section composed of sheet feeding tray 41, movable bottom plate 42 and pushing up lever 43 and with a cover sheet feeding means composed of pickup roller 44, feed roller 45 and fanning roller 46.

A sheet of cover sheet K fed from cover sheet feeding means 40 passes through path 47, then passes through the position of nipping between driving roller 74A and driven roller 74C both of the conveyance paired rollers 74, then passes through path 79 and conveyance paired rollers 78, and arrives at intermediate stacker 35 through conveyance paired rollers 32 of the third path (iii), path 33 and conveyance paired rollers 34.

Conveyance paired rollers 74 is composed of central driving roller 74A, and two driven rollers 74B and 74C which are in pressure contact with the driving roller 74A. When the driving roller 74A rotates counterclockwise in the illustration, the driven roller 74B is rotated clockwise to convey recording sheet S conveyed through path 73 upward. Simultaneously with this, the driven roller 74C is also rotated clockwise to convey cover sheet K conveyed from path 47 to lower path 79. Therefore, the rotation of the driving roller 74A makes it possible to convey recording sheet S on the fist conveyance path (i) and cover sheet K on the fourth conveyance path (iv) to the opposite directions each other simultaneously.

(5) Fifth conveyance path (v) (midway stapling mode)

When setting to the midway stapling mode, movable stopper member 51 in the vicinity of the position for staple processing.of stapler 50 is retracted from the conveyance path, and almost simultaneously with this, movable stopper member 53 which is located at the downstream side of the movable stopper member 51 starts operating to close the path 52.

When the size (length in the conveyance direction) of cover sheet K and recording sheet S is set or detected, the movable stopper member 53 moves to the prescribed position to stop there.

After cover sheet K is placed at the prescribed position on the intermediate stacker 35, recording sheets S conveyed out of image forming apparatus A pass through the third conveyance path (iii) from entrance conveyance section 70 of sheet finisher FS, and are stacked successively on the upper surface of the cover sheet K placed on the intermediate stacker 35, and are positioned with rear end portions of the recording sheets S coming in contact with the movable stopper member 53.

After the last recording sheet S is positioned and stacked on the intermediate stacker 35, a bundle of sheets composed of the cover sheet K and all pages of the recording sheets S is subjected to midway stapling processing conducted by stapler 50. During this midway stapling processing, a staple is driven in the cover sheet and recording sheets at their central portion in the conveyance direction for the cover sheet. K and the recording sheets S.

(5) Sixth conveyance path (vi) (folding mode)

Figure 4:
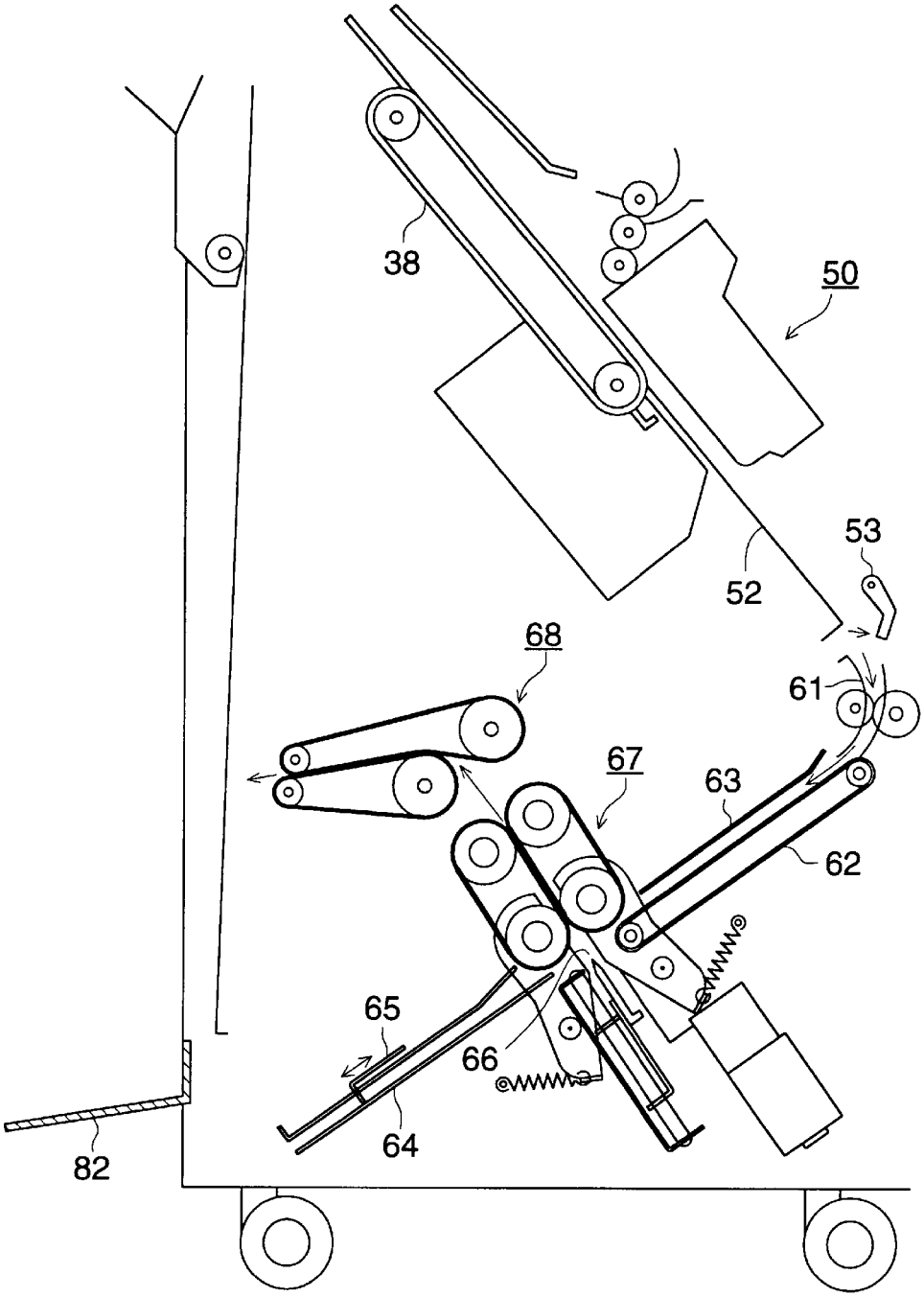
FIG. 4 is a sectional view showing the structure of the lower portion of the sheet finisher.

FIG. 4 is a sectional view showing the structure of the lower portion of the sheet finisher FS.

After the midway stapling, the movable stopper member 53 swivels and opens the path on the downstream side on path 52. A bundle of sheets composed of cover sheet K and recording sheets S subjected to midway stapling passes through curved path 61 and is guided on conveyance belt 62 located to be obliquely lower by guide plate 63, and further, slides down along guide plate 64, and stops at the prescribed position with a rear end portion of the bundle of sheets coming into contact with movable stopper member 65. The movable stopper member 65 can move to the prescribed position with setting of detection of the sheet size and with a driving means.

There is provided protruding unit 66 at the location obliquely lower than the central portion of a suspended bundle of sheets in its conveyance direction, namely at the location obliquely lower than the midway stapling position. At the location obliquely higher than the midway stapling position, there are provided folding paired rollers section 67 and twofold sheet conveyance means 68.

Figure 5:
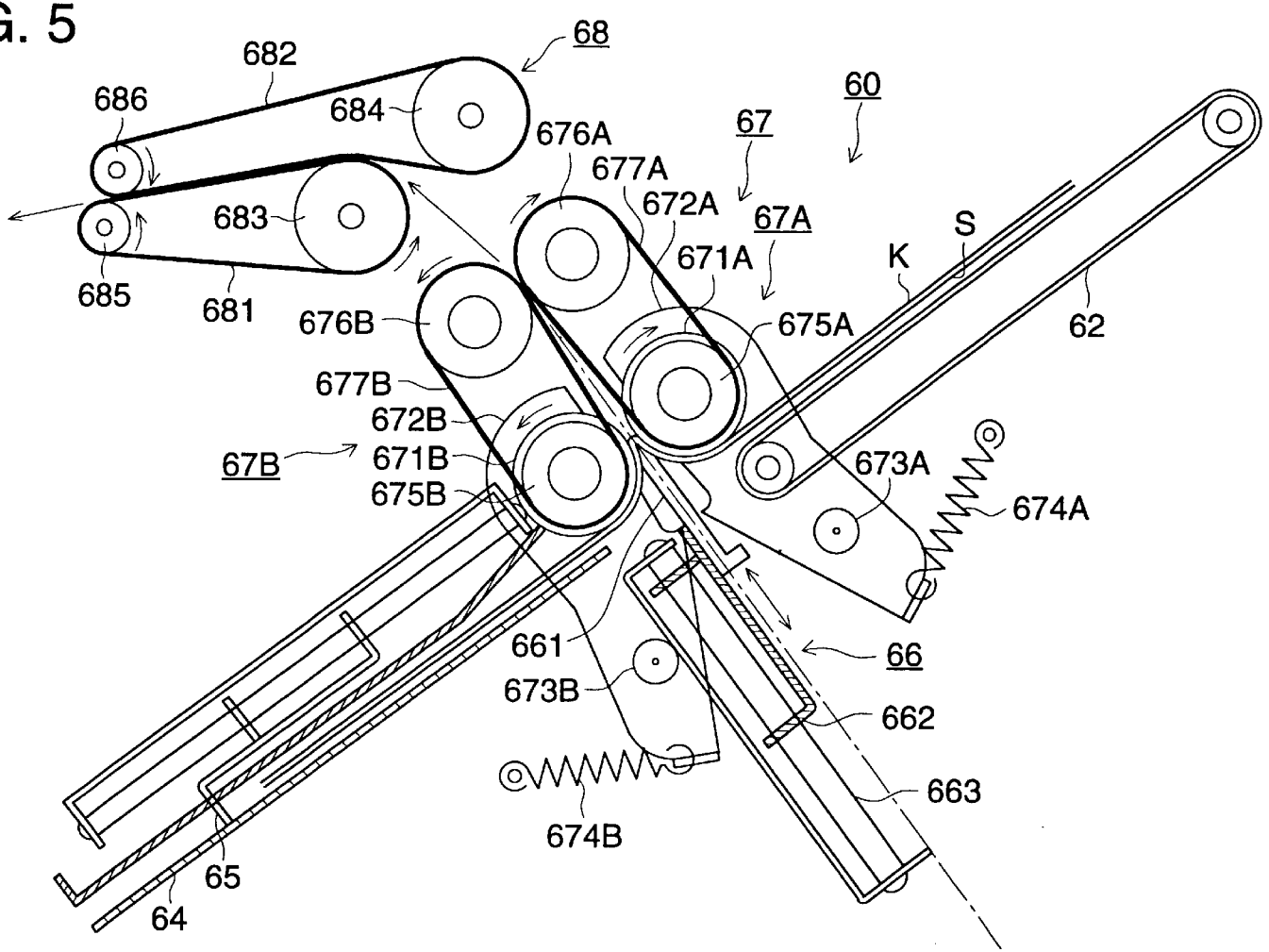
FIG. 5 is a sectional view showing a protruding unit, a folding paired rollers section, and a folded sheet conveyance means.

FIG. 5 is a sectional view of folding means 60 which is composed of protruding unit 66, folding paired rollers section 67 and twofold sheet conveyance means 68.

Responding to start folding signals, movable holding member 662 advances straight along guide bar 663 which is arranged to be fixed, and protruding plate 661 fixed on the movable holding member 662 protrudes above the sheet placing surface. The protruding plate 661 is of a thin knife shape and its tip portion is formed to be an acute angle.

The tip portion of the protruding plate 661 which has advanced straight up obliquely and protruded pushes up the central portion of a bundle of sheets composed of cover sheet K and recording sheets S, and then, pushes apart the folding paired rollers section 67 at their nipping section through the bundle of sheets so that the folding rollers may be swiveled and separated.

After the tip portion of the protruding plate 661 has passed through the nipping section, the protruding plate 661 is retreated and the central portion of the bundle of sheets is nipped and pressed by the folding paired rollers section 67 to be rimpled. The rimple thus formed mostly agrees in terms of position with the stapling position in the midway stapling processing for a staple on the bundle of sheets.

Pressing means 67A on one side of the folding paired rollers section 67 is made up of a front folding section composed of first pressing roller 671A which is connected to the driving source to be driven, arm 672A which rotatably supports the first pressing roller 671A and is capable of swiveling around supporting shaft 673A, and spring 674A which is hooked on one end of the arm 672A to urge the first pressing roller 671A toward the nipping position, and of a rear folding section composed of second pressing roller 676A which is connected to the driving source to be driven, and conveyance belt 677A trained about pulley 675A which is coaxial with the first pressing roller 671A and the second pressing roller 676A.

Pressing means 67B on the other side is also structured in the same way, and it is composed of first pressing roller 671B, arm 672B, supporting shaft 673B, spring 674B, pulley 675B, second pressing roller 676B and conveyance belt 677B. Incidentally, the second pressing rollers 676A and 676B are supported rotatably by an unillustrated arm, supporting shaft and spring which are the same as those for the first pressing rollers 671A and 671B.

The central portion of the bundle of sheets pressed by the rotating first pressing rollers 671A and 671B to create a rimple thereon is nipped by conveyance belts 677A and 677B to be conveyed, then, fed into the position of nipping by the second pressing rollers 676A and 676B where the rimple is made to be more clear, and is fed into twofold sheet conveyance means 68.

The twofold sheet conveyance means 68 is composed of lower conveyance belt 681 and upper conveyance belt 682 both nip and convey a bundle of sheets. The lower conveyance belt 681 is trained about driving roller 683 and driven roller 685, and is capable of rotating. The upper conveyance belt 682 is trained about driving roller 684 and driven roller 686, and is capable of rotating.

The bundle of sheets fed into by the twofold sheet conveyance means 68 is nipped between the lower conveyance belt 681 and the upper conveyance belt 682 to be conveyed, and is ejected onto fixed sheet ejection tray 82 which is located outside the apparatus.

Figure 6:
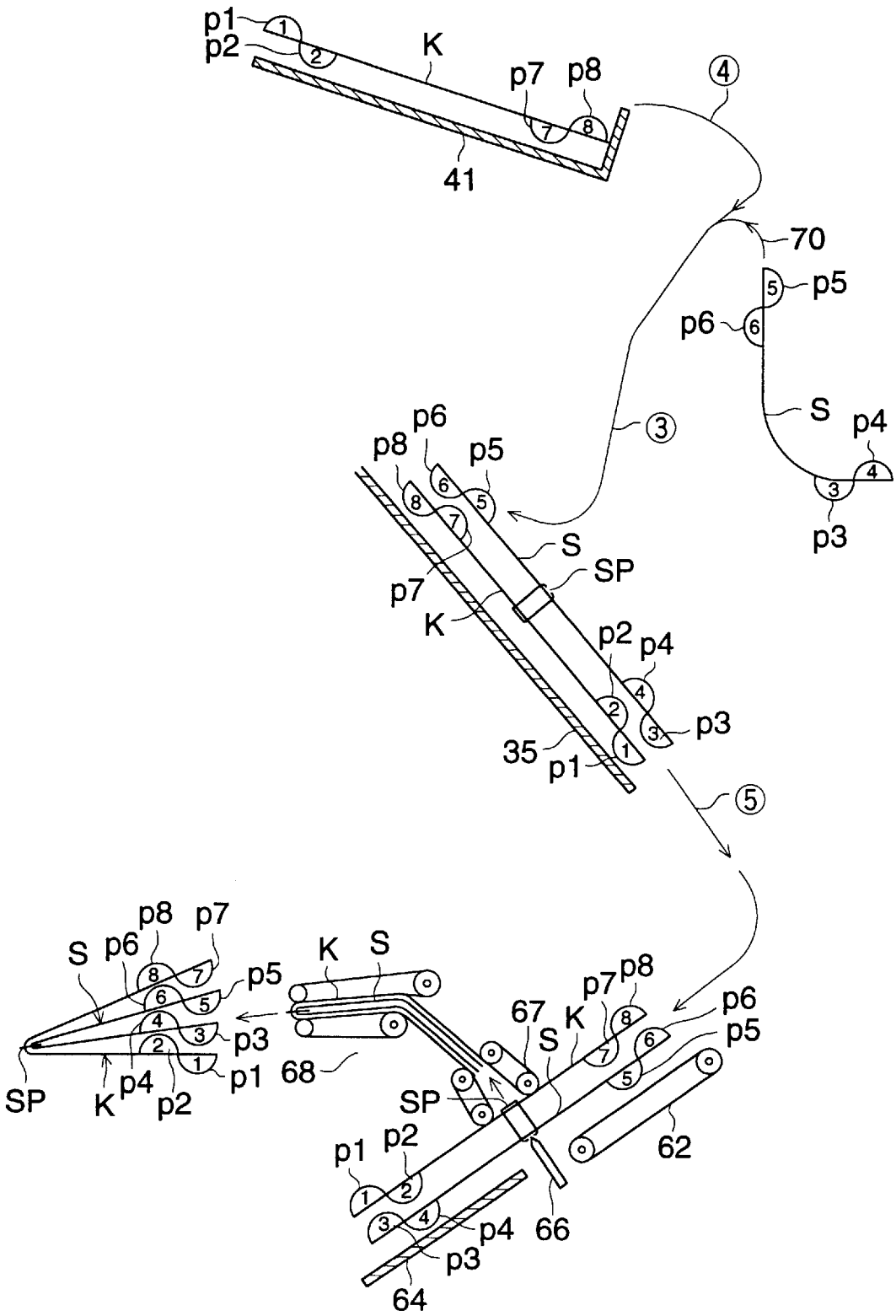
FIG. 6 is an illustration diagram showing the conveyance path for the cover sheet and recording sheets, and the processing process for midway stapling and folding of a bundle of sheets.
Figure 7:
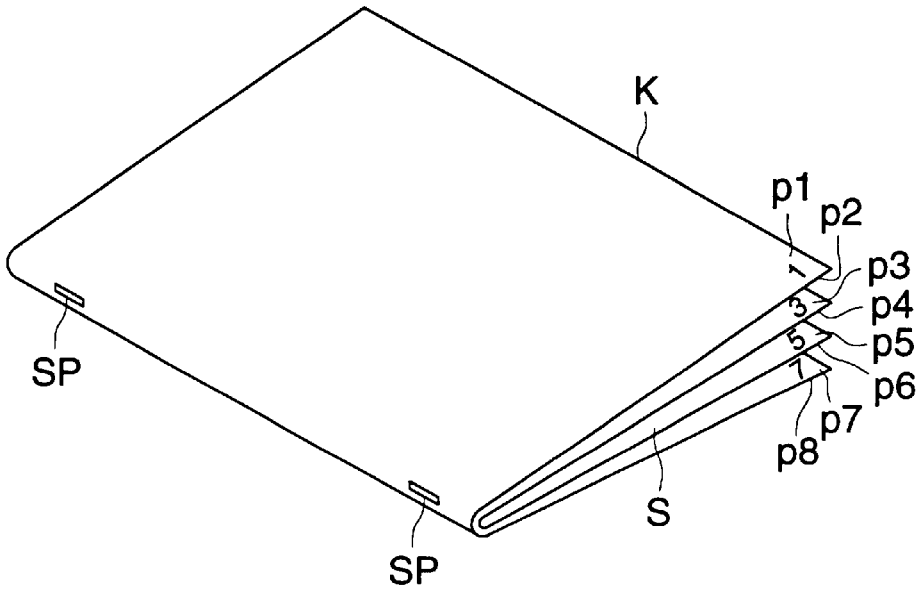
FIG. 7(*a*) is a perspective view of a booklet which has been subjected to finishing of midway stapling and folding, and FIG. 7(*b*) is a perspective view showing the finished booklet which is opened.
Figure 7:
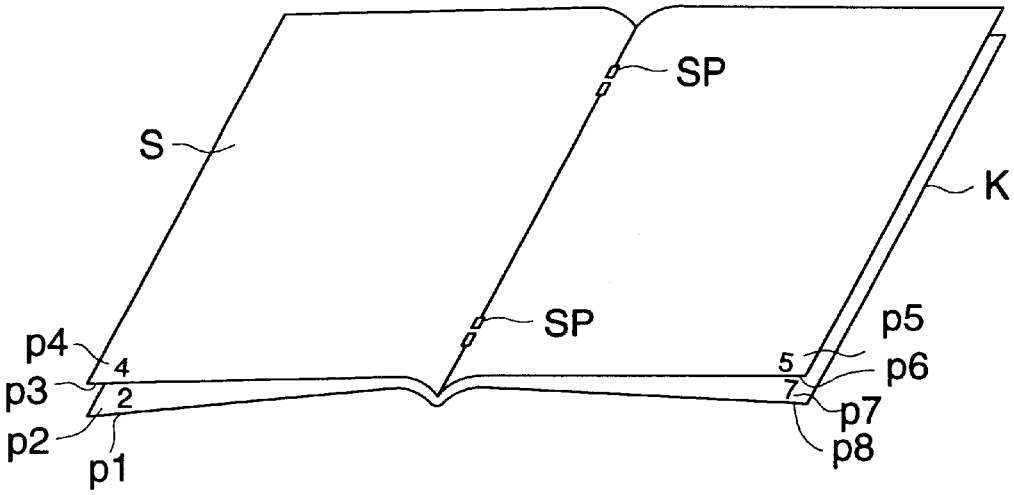

FIG. 6 is an illustration diagram showing the conveyance path for the cover sheet and recording sheets, and the processing process for midway stapling and folding of a bundle of sheets. FIG. 7(*a*) is a perspective view of a booklet which has been subjected to finishing of midway stapling and folding, and FIG. 7(*b*) is a perspective view showing the finished booklet which is opened.

On sheet-feeding tray 41 of cover sheet-feeding means 40, there is placed cover sheet K with its first surface (p1 on page 1 and p8 on page 8) facing upward. Cover sheet K fed from sheet-feeding tray 41 by the sheet-feeding means is conveyed through the fourth conveyance path (iv) and the third conveyance path (iii) and is placed, with its first surface (p1, p8) facing downward, on intermediate stacker 35.

Next, recording sheet S having thereon a formed image conveyed out of image forming apparatus A is guided, with its first surface (p1 on page 3 and p6 on page 6) facing downward into sheet finisher FS. This recording sheet S is conveyed from entrance conveyance section 70 to the third conveyance path (iii) and then is placed with its first surface facing downward on cover sheet K that is placed on intermediate stacker 35.

The cover sheet K and the recording sheets S are collated and adjusted on the intermediate stacker 35, and staple SP is driven in them by stapler 50 for midway stapling processing.

A bundle of sheets subjected to midway stapling passes through fifth conveyance path (v), then is placed at the prescribed position on guide plate 64 and conveyance belt 62, and is stopped. In this case, the bundle of sheets is placed in a way wherein the first surface (p3 on page 3 and p6 on page 6) of the recording sheet S faces upward and the first surface (p1, p8) of the cover sheet K superposed on the recording sheet faces upward.

Then, twofold processing is carried out by pushing up operation of protruding unit 66 and by rotation of folding paired rollers section 67, and then, twofold sheet conveyance means 68 nips and conveys to eject onto fixed sheet ejection tray 82 located outside the apparatus.

With regard to the booklet made through midway stapling processing and folding processing, the first surface (p1, p8) of cover sheet K is turned toward the outside, the second surface (p2, p7) is arranged on the back side of the first surface, the first surface (p3, p6) of recording sheet S representing contents is arranged inside the second surface, and the second surface (p4, p5) of recording sheet S is arranged inside the first surface of the recording sheet S, thus, collation of the booklet having therein 8 pages (p1–p8) as illustrated can be conducted.

Each of FIGS. 8(*a*) and 8(*b*) is a block diagram showing the control of the sheet finisher of the invention.

In operation section (S 101) of image forming apparatus A in FIG. 8(*a*), when printing is started by selecting and setting a booklet making automatic mode (S 102) and by stacking cover sheets K on sheet-feeding tray 41, the image processing (S 104) is executed by control section (S 103) of image forming apparatus A, then, recording sheet S carrying images is subjected to midway stapling and folding processing by sheet finisher device FS, and booklets are continuously made and ejected (S 105).

In operation section (S 201) of sheet finisher device FS in FIG. 8(*b*), when feeding out operation is started by selecting and setting a booklet making manual mode (S 202) and by stacking cover sheet K and stacking recording sheets S each having thereon a formed image equivalent in terms of quantity to one copy under the cover sheet K on sheet-feeding tray 41, the cover sheet K and recording sheets S are subjected to midway stapling processing and folding processing by control section (S 203) of sheet finisher FS, and a booklet equivalent to one copy is made and ejected out (S 204).

FIG. 9 is a sectional view showing another embodiment of the folding means of the sheet finisher of the invention. Incidentally, with regard to symbols used in the diagram, items having the same functions as those in FIG. 5 are given the same symbols. Further, some points which are different from those in the aforesaid embodiment will be explained.

Folding paired rollers section 67 has first pressing rollers 671A and 671B and it rimples the central portion of a bundle of sheets which has been pushed out by protruding plate 661. After the protruding plate 661 is retreated from the position in the vicinity of the nipping position between the first pressing rollers 671A and 671B, the bundle of sheets is fed into twofold sheet conveyance means 69.

The twofold sheet conveyance means 69 is composed of upper pressing conveyance means 69A and lower pressing conveyance means 69B. The upper pressing conveyance means 69A is composed of pressing roller 691A, driven roller 693A, tension roller 695A and conveyance belt 692A which is trained about the aforesaid rollers. The lower pressing conveyance means 69B is composed of pressing roller 691B, driven roller 693B, intermediate roller 694, tension roller 695B and conveyance belt 692B which is trained about the aforesaid rollers.

The bundle of sheets fed into twofold sheet conveyance means 69 is nipped between pressing roller 691A and pressing roller 691B, and the rimple is made to be more clear at this nipping position, and the bundle of sheets is further held between conveyance belts 692A and 692B, then is conveyed to be ejected onto fixed sheet ejection tray 82 which is located outside the apparatus.

Incidentally, though a sheet finisher connected to a copying machine has been shown in the embodiment of the invention, it can also be applied to a sheet finisher used by connecting to an image forming apparatus such as a printer or a facsimile machine and to a light printing machine.

Due to the several structures of the sheet finisher of the invention, processing for inserting a cover sheet, midway stapling processing and folding processing are carried out through easy operation, and they are attained by the compact structure requiring the minimum floor space.

Due to another structure, the driving system for the sheet finisher can be simplified.

Due to still another structure, logical arrangement of a conveyance path for cover sheets, a conveyance path for finishing recording sheets and a conveyance path for recording sheets requiring no finishing improves conveyance productivity for finishing cover sheets and recording sheets.

Due to furthermore another structure, by providing a manual mode to be controlled by sheet finisher side in addition to an automatic mode controlled from the main body of an image forming apparatus, it is possible to conduct individual binding of cover sheets, finishing of recording sheets each having thereon a formed image which are ejected, and finishing of a bundle of sheets after reediting including addition and elimination of sheets, by changing modes. Further, the sheet finisher itself can display the function as a sheet folding machine, and the sheet finisher is improved in terms of easy operation.

What is claimed is:

1. A sheet finisher comprising:

(a) an intermediate stacking member for aligning a plurality of recording sheets each on which an image has been recorded and for stacking the plurality of recording sheets thereon while the recording sheets are kept flat;

(b) a cover sheet feeding member having a cover sheet loading section for loading a cover sheet, which is provided above the intermediate stacking member, for feeding the cover sheet stacked on the cover sheet loading section to the intermediate stacking member while the cover sheet is kept flat;

(c) a stapling member provided on the intermediate stacking member and below the cover sheet loading section for stapling the cover sheet and the recording sheets together at a central portion of the cover sheet and the recording sheets both stacked on the intermediate stacking member by making a staple to pass from a side of the cover sheet to a side of the recording sheets and then to bend the staple for binding; and (d) a folding member provided below the stapling member for folding concurrently the cover sheet and the recording sheets into two at a stapled position of the cover sheet and the recording sheets which have been stapled together by the stapling member, wherein the cover sheet feeding member, the intermediate stacking member and the folding member are vertically arranged in the order from an upper portion to a lower portion of the sheet finisher.

2. The sheet finisher of claim 1 wherein the cover sheet is placed with a first surface thereof facing upward on the cover sheet loading section.

3. The sheet finisher of claim 2 wherein the cover sheet which has been placed on the cover sheet loading section is stacked upside down on the stacking member.

4. The sheet finisher of claim 3 wherein the cover sheet feeding member is controlled to stack the cover sheet onto the stacking member before the recording sheets each on which an image has been recorded are stacked on the stacking member.

5. The sheet finisher of claim 1 further comprising:

a sheet exit tray into which the recording sheets which have been folded by the folding member are ejected; and a movable sheet delivery tray into which the recording sheets which have not been folded by the folding member are delivered.

6. The sheet finisher of claim 5 wherein a second conveyance path for conveying the cover sheet fed out of the cover sheet feeding member to the stacking member joins a third conveyance path upstream of a branching point between the third conveyance path for conveying the recording sheet to the stacking member and a fourth conveyance path for conveying the recording sheet to the movable sheet delivery tray without passing through the stacking member.

7. The sheet finisher of claim 1 further comprising a shifting member for shifting the recording sheets in a direction perpendicular to a conveyance direction thereof.

8. The sheet finisher of claim 7 wherein the cover sheet feeding member, the shifting member, the stacking member and the folding member are vertically arranged in the order from the upper portion to the lower portion of the sheet finisher.

9. The sheet finisher of claim 7 further comprising:

a movable delivery tray into which the recording sheets which have not been folded by the folding member, are delivered; and a conveyance path through which the recording sheets are conveyed to the movable delivery tray without passing through the stacking member, wherein the shifting member is disposed in the conveyance path, and the recording sheets shifted by the shifting member are delivered to the movable delivery tray.

10. The sheet finisher of claim 1 wherein the sheet finisher is capable of being interlocked with an image forming apparatus, and capable of selecting the following modes, an automatic mode wherein the cover sheet fed out of the cover sheet feeding member and the recording sheets fed from the image forming apparatus on which images have been recorded respectively, are stacked on the stacking member, and then the cover sheet and the recording sheets are stapled by the stapling member or folded by the folding member to successively form booklets, and a manual mode wherein one cover sheet and the recording sheets corresponding to one booklet are stacked on the cover sheet loading section and are fed to the stacking member, and then are stapled by the stapling member or folded by the folding member to form a booklet corresponding to one booklet.

11. The sheet finisher of claim 10 wherein the automatic mode is designated by an operation section of the image forming apparatus and the manual mode is designated by an operation section of the sheet finisher.

12. A sheet finisher comprising:

(a) an intermediate stacking member for aligning a plurality of recording sheets each on which an image has been recorded and for stacking the plurality of recording sheets thereon;

(b) a cover sheet feeding member having a cover sheet loading section for loading a cover sheet for feeding the cover sheet stacked on the cover sheet loading section to the intermediate stacking member;

(c) a stapling member provided on the intermediate stacking member and below the cover sheet loading section for stapling the cover sheet and the recording sheets together at a central portion of the cover sheet and the recording sheets both stacked on the intermediate stacking member; and (d) a folding member for folding the cover sheet and the recording sheets into two at the central portion of the cover sheet and the recording sheets which have been stapled together by the stapling member, wherein the cover sheet feeding member, the intermediate stacking member and the folding member are vertically arranged in the order from an upper portion to a lower portion of the sheet finisher, a fixed sheet delivery tray into which recording sheets which are neither stapled by the stapling member nor folded by the folding member, are ejected, wherein the fixed sheet delivery tray is disposed above the cover sheet feeding member;

a first conveyance path through which the recording sheets are conveyed to the fixed sheet delivery tray;

a second sheet conveyance path arranged to adjoin the first conveyance path, through which the cover sheet fed out of the cover sheet feeding member is conveyed to the stacking member;

a common conveyance roller arranged extending over the first and second conveyance paths at an adjoining portion thereof;

a first conveyance roller provided in the first conveyance path for interposing and conveying the recording sheet with the common conveyance roller; and a second conveyance roller provided in the second conveyance path for interposing and conveying the cover sheet with the common conveyance roller, wherein the recording sheet conveyed in the first conveyance path and the cover sheet conveyed in the second conveyance path are conveyed in an opposite direction to each other by virtue of the common conveyance roller, the first conveyance roller and the second conveyance roller.

13. The sheet finisher of claim 12 wherein the common conveyance roller is a driving roller, and both the first and second conveyance rollers are follower rollers.

14. An image forming apparatus having a sheet finisher, the sheet finisher comprising:

(a) an intermediate stacking member for aligning a plurality of recording sheets each on which an image has been recorded and for stacking the plurality of recording sheets thereon while the recording sheets are kept flat;

(b) a cover sheet feeding member having a cover sheet loading section for loading a cover sheet, which is provided above the intermediate stacking member, for feeding the cover sheet stacked on the cover sheet loading section to the intermediate stacking member while the cover sheet is kept flat;

(c) a stapling member provided on the intermediate stacking member and below the cover sheet loading section for stapling the cover sheet and the recording sheets together at a central portion of the cover sheet and the recording sheets both stacked on the intermediate stacking member by making a staple to pass from a side of the cover sheet to a side of the recording sheets and then to bend the staple for binding; and (d) a folding member provided below the stapling member for folding concurrently the cover sheet and the recording sheets into two at a stapled position of the cover sheet and the recording sheets which have been stapled together by the stapling member, wherein the cover sheet feeding member, the intermediate stacking member and the folding member are vertically arranged in the order from an upper portion to a lower portion of the sheet finisher.

15. A sheet finisher comprising:

(a) a stacking member for aligning a plurality of recording sheets each on which an image has been recorded and for stacking the plurality of recording sheets thereon;

(b) a cover sheet feeding member having a cover sheet loading section for loading a cover sheet, for feeding the cover sheet stacked on the cover sheet loading section to the stacking member;

(c) a stapling member for stapling the cover sheet and the recording sheets stacked on the stacking member; and (d) a folding member for folding the cover sheet and the recording sheets into two;

wherein the cover sheet feeding member, the stacking member and the folding member are substantially vertically arranged in the order from an upper portion to a lower portion of the sheet finisher;

a fixed sheet delivery tray into which recording sheets which are neither stapled by the stapling member nor folded by the folding member, are ejected, wherein the fixed sheet delivery tray is disposed above the cover sheet feeding member;

a first conveyance path through which the recording sheets are conveyed to the fixed sheet delivery tray;

a second sheet conveyance path arranged to adjoin the first conveyance path, through which the cover sheet fed out of the cover sheet feeding member is conveyed to the stacking member;

a common conveyance roller arranged extending over the first and second conveyance paths at an adjoining portion thereof;

a first conveyance roller provided in the first conveyance path for interposing and conveying the recording sheet with the common conveyance roller; and a second conveyance roller provided in the second conveyance path for interposing and conveying the cover sheet with the common conveyance roller, wherein the recording sheet conveyed in the first conveyance path and the cover sheet conveyed in the second conveyance path are conveyed in an opposite direction to each other by virtue of the common conveyance roller, the first conveyance roller and the second conveyance roller.

16. The sheet finisher of claim 15 wherein the common conveyance roller is a driving roller, and both the first and second conveyance rollers are follower rollers.

* * * * *